US005730831A

United States Patent [19]

Jensen, Jr. et al.

[11] Patent Number: 5,730,831

[45] Date of Patent: Mar. 24, 1998

[54] ADJUSTABLE TAPE WIDTH CASE SEALER

[75] Inventors: Van E. Jensen, Jr., Stillwater; Michael R. Mitchell, St. Paul; Lloyd S. Vasilakes, Stillwater, all of Minn.

[73] Assignee: Minnesota Mining and Manufacturing Company, St. Paul, Minn.

[21] Appl. No.: 609,818

[22] Filed: Mar. 1, 1996

[51] Int. Cl.[6] ..... B65C 9/02

[52] U.S. Cl. ..... 156/475; 156/468; 156/486; 198/817; 198/860.1; 198/626.5

[58] Field of Search ..... 156/468, 475, 156/486; 53/136.4; 198/817, 626.5, 860.5, 806.4, 860.3, 860.1; 242/578

[56] References Cited

U.S. PATENT DOCUMENTS

| | | | |
|---|---|---|---|
| D. 328,307 | 7/1992 | Belletire et al. | D15/145 |
| 1,773,153 | 8/1930 | Remnsnider | 242/578 |
| 3,676,272 | 7/1972 | White et al. | 156/486 |
| 4,161,138 | 7/1979 | Marchetti | 53/136.4 |
| 4,238,269 | 12/1980 | Deering, Jr. | 156/465 |
| 4,392,911 | 7/1983 | Ulrich et al. | 156/468 |
| 4,473,150 | 9/1984 | Marchetti | 198/860.3 |
| 4,545,176 | 10/1985 | Marchetti | 53/136.4 |
| 4,789,418 | 12/1988 | Rayl | 156/468 |
| 4,875,895 | 10/1989 | Donnay et al. | 493/117 |
| 4,889,581 | 12/1989 | Ulrich et al. | 156/468 |
| 4,991,787 | 2/1991 | Berg | 242/76 |
| 5,173,140 | 12/1992 | Vasilakes | 156/212 |
| 5,227,002 | 7/1993 | Faust et al. | 156/468 |
| 5,228,943 | 7/1993 | Vasilakes | 156/468 |
| 5,323,586 | 6/1994 | Lissoni et al. | 53/136.4 |
| 5,421,948 | 6/1995 | Crankshaw et al. | 156/486 |

FOREIGN PATENT DOCUMENTS

| | | | |
|---|---|---|---|
| 0 187 394 | 7/1986 | European Pat. Off. | B65B 51/06 |
| 0 502 276 A2 | 9/1992 | European Pat. Off. | B65B 51/06 |
| 1 512 749 | 11/1976 | United Kingdom | B65B 51/06 |

*Primary Examiner*—David A. Simmons
*Assistant Examiner*—Linda L. Gray
*Attorney, Agent, or Firm*—Charles D. Levine

[57] ABSTRACT

A tape applying apparatus adjustable to accommodate various width taping heads. The apparatus includes a base, left and right bed portions separated by a central open portion, and left and right filler plates mounted in the central open portion. The distance between the filler plates can be adjusted to adjust the width of the central open portion and accommodate lower taping heads of different widths. Replaceable front and rear guards are placed on the front and rear of the bed across the ends of both filler plates. The apparatus can also include an upper frame for supporting an upper taping head. The upper frame includes two support members. A rear spacer connecting the two support members, a front support plate, and a top cover can be replaced or adjusted to accommodate an adjustable upper taping head width.

16 Claims, 7 Drawing Sheets

ADJUSTABLE TAPE WIDTH CASE SEALER

TECHNICAL FIELD

The present invention relates to an apparatus for applying tape to an object. More particularly, the present invention relates to an apparatus for applying pressure sensitive adhesive tape to seal boxes.

BACKGROUND OF THE INVENTION

In the packaging field, it is useful to seal containers, particularly cartons, with pressure sensitive adhesive tape. Two common types of cartons are the display carton (also known as a telescopic design box) and the regular slotted carton (also known as a regular slotted container.

The display carton includes a lower tray portion, in which the contents of the carton are placed, and an upper closure portion that covers the tray portion. The tray portion and the closure portion fit together, typically with the tray portion inside the closure portion, to be sealed by adhering one or more pieces of tape across the lower leading and trailing edges.

The regular slotted carton is generally a rectangular parallelepiped, including upright leading and trailing surfaces, two side surfaces, and top and bottom surfaces. The top and bottom surfaces each include four flaps. A flap is connected to the leading and trailing surfaces, and to each of the side surfaces. These flaps are folded inwardly to close the carton. The flaps connected to the edges of the leading and trailing surfaces typically are folded inwardly first, and the flaps connected to the edges of the side walls are folded second, to position the side wall flaps in abutting relationship along the length of the top and bottom surfaces. To seal the carton, a section of tape can be applied to the flaps along the interface to adhere them together.

Devices for applying pressure sensitive adhesive tape sections from a supply to seal boxes driven past the device by a conveyer are well known. Typically, such devices include an application member such as a roller for supporting an end of tape to be contacted by a box. Upon such contact, the tape end adheres to the box. Further movement of the box pulls tape from the device between the box and the application member which presses the tape against the box. The applied length of tape is severed from the supply and the newly severed end of the tape supply is moved with the application member back to its contact position for contact by the next box on the conveyer.

Typically, the application member is mounted at one end of an arm. The other arm end is movably mounted at one edge of the path for the boxes. After the leading surface of the box contacts the tape on the application member, the application member moves to follow the contour of the box and press tape against the box to seal the cover flaps together.

U.S. Pat. No. 4,789,418 discloses an apparatus having a taping head for applying an L-clip of tape to the leading and lower surfaces, and to the lower and trailing surfaces of the carton. One or more L-clips of tape can also be applied across other carton surfaces. An L-clip of tape is adhered to two perpendicular surfaces of an object with the cross-sectional shape of the tape section resembling an "L"

The tape applicator of the '418 patent includes an application roller that is initially located in the path of the object, and has one end of a continuous supply of adhesive tape. The adhesive side of the tape is presented for contact with the leading surface of the carton as the carton is urged against the application roller. After the application roller contacts the leading surface of the carton, the roller is pivoted away from the carton by a pneumatic cylinder to a position beneath and spaced from the bottom surface of the carton. A blade severs the tape, and buffing rollers press the tape against the leading and bottom surfaces of the carton to ensure adhesion. A similar process is followed to adhere an L-clip of tape to the lower trailing corner of the carton. The '418 patent apparatus also has a stripper assembly which strips tape from the tape supply and maintains tape tension during application.

Other types of tape applicators are also known. For example, U.S. Pat. No. 4,238,269 discloses a C-clip applicator. The apparatus applies a continuous length of pressure sensitive adhesive tape to a portion of the leading surface of a carton, across the top surface of the carton to seal the abutting flaps together, and to a portion of the trailing surface of the carton. The cross-sectional view of this segment of tape resembles a "C."

The application roller of the '269 patent applies a uniform force against the leading surface of the carton being sealed. The application roller moves generally linearly in response to the application of force by a carton. Previously known application rollers pivot around a fixed axis, due to the increasing compressive forces applied by a pivoting application arm to the corner of the carton.

U.S. Pat. No. 5,227,002 discloses a tape applying apparatus having a frame, a tape supply mounted on the frame, an application member, and a support arm to support the application member. A first shifter shifts the support arm from an extended position, where the application member is in the object path, to a retracted position, where the application member is above the object. The tape from the tape supply extends to the application member with the adhesive side of the tape presented by the application member for contact with the leading surface of the object. A knife severs a section of tape from the tape supply. A second shifter shifts the knife between a retracted position, away from the tape path, and an extended position, at or through the tape path, when the support arm is retracted. When the object initially contacts the tape, the first shifter shifts the support arm from the extended position to the retracted position to locate the application member above the object. When the support arm reaches the retracted position and the leading surface of the object is further along the object path than is the application member, the second shifter shifts the knife from the retracted position to the extended position, severing the section of tape from the tape supply. The first shifter returns the support arm to the extended position and the second shifter returns the knife to the retracted position after the tape has been severed. Drive belts move the box past the taping heads.

These known case sealers use a fixed cavity width on the frame for the application member, also known as a taping head. If a narrower taping head is installed, spacers must be used to center it within the cavity. However, the drive belts used to move the boxes can not be moved closer to each other, so the minimum box width remains the same as with the wider taping head to maintain sufficient contact between the box and the belt. If a wider taping head is desired, the known machines can not increase the head cavity width to wider than that for which the case sealer is designed. Another case sealing machine, designed for wider taping head cavities must be used.

There is a need for a case sealer which has an adjustable taping head width which enables using wider and narrower tape widths while being able to seal smaller boxes with the smaller head widths.

SUMMARY OF THE INVENTION

The invention is a tape applying apparatus which can have at least one taping head for applying a section of tape to an object. The apparatus is adjustable to accommodate various width taping heads and boxes. The apparatus includes a base having a surface on which the objects travel. The base includes left and right bed portions separated by a wide central open portion. Left and right filler plates are mounted longitudinally in the central open portion adjacent the respective left and right bed portions, and over which drive belts can pass to transport objects through the apparatus. The distance between the left and right filler plates can be adjusted to adjust the width of the central open portion from a minimum width to a maximum width.

Each filler plate can include an arm portion which rests over the adjacent bed portion with sufficient overlap to prevent any gaps between the filler plate and the adjacent bed portion regardless of whether the filler plates are arranged to create the minimum width central open portion or the maximum width central open portion. Also, each filler plate can include a lip formed on each end of the arm portion. The lip is receivable in a slot formed in the bed portion to secure the filler plates in place longitudinally.

The filler plates can be mounted on the base using cross bars on which the filler plates rest. Some combination of one or more holes formed on the filler plates and the cross bars and a slot formed on the filler plates and the cross bars is used to secure the filler plates in the desired location on the base. The selection of a particular hole or location within a slot determines the width of the central open portion.

A replaceable front guard is placed on the front of the bed across the front ends of both filler plates, and a replaceable rear guard is placed on the rear of the bed across the rear ends of both filler plates. Each guard includes a lip which fits over the end of the bed of the base and two openings through which drive belts can pass. A drive roller and an idler roller around which a drive belt passes can be used. The rollers can be adjustable in a transverse direction to accommodate adjusting the filler plates. Each roller is located within a respective opening in a guard plate.

The apparatus can include a lower taping head for 25 applying the tape to at least one of (a) a lower longitudinal surface, (b) a portion of a leading surface adjacent the lower longitudinal surface, and (c) a portion of a trailing surface adjacent the lower longitudinal surface.

The apparatus can also include an upper frame for supporting an upper taping head above the base portion. The upper frame includes a cross brace and two support members which are mounted longitudinally on the cross brace and which can receive between them an upper taping head. A rear spacer connects the two support members, a front support plate is mounted below the support members and guides the tops of boxes, and a top cover is located on top of the support members above the front support plate. The rear spacer, front support plate, and top cover are at least one of (a) replaceable with similar components of different widths to accommodate width changes and (b) formed of overlapping, nesting portions to adjust the width.

The apparatus can also include an upper taping head for applying the tape to at least one of (a) an upper longitudinal surface, (b) a portion of a leading surface adjacent the upper longitudinal surface, and (c) a portion of a trailing surface adjacent the upper longitudinal surface.

The apparatus can include supporting columns translatable with respect to the base on which the upper frame is mounted. The upper taping head height is adjustable and it is allowed to float to accommodate objects of different heights. This is accomplished by a nut fixed to the base at a location corresponding to each supporting column and a lead screw threaded through and supported by each nut. The upper frame rests on the lead screw and the lead screw can be threaded through the nut to raise and lower the upper frame. A spring compressed between the upper surface of each lead screw and the upper frame permits an object to raise the upper frame. The upper frame rests on and compresses the spring until the upper frame contacts the stop.

DETAILED DESCRIPTION

Figure 1:
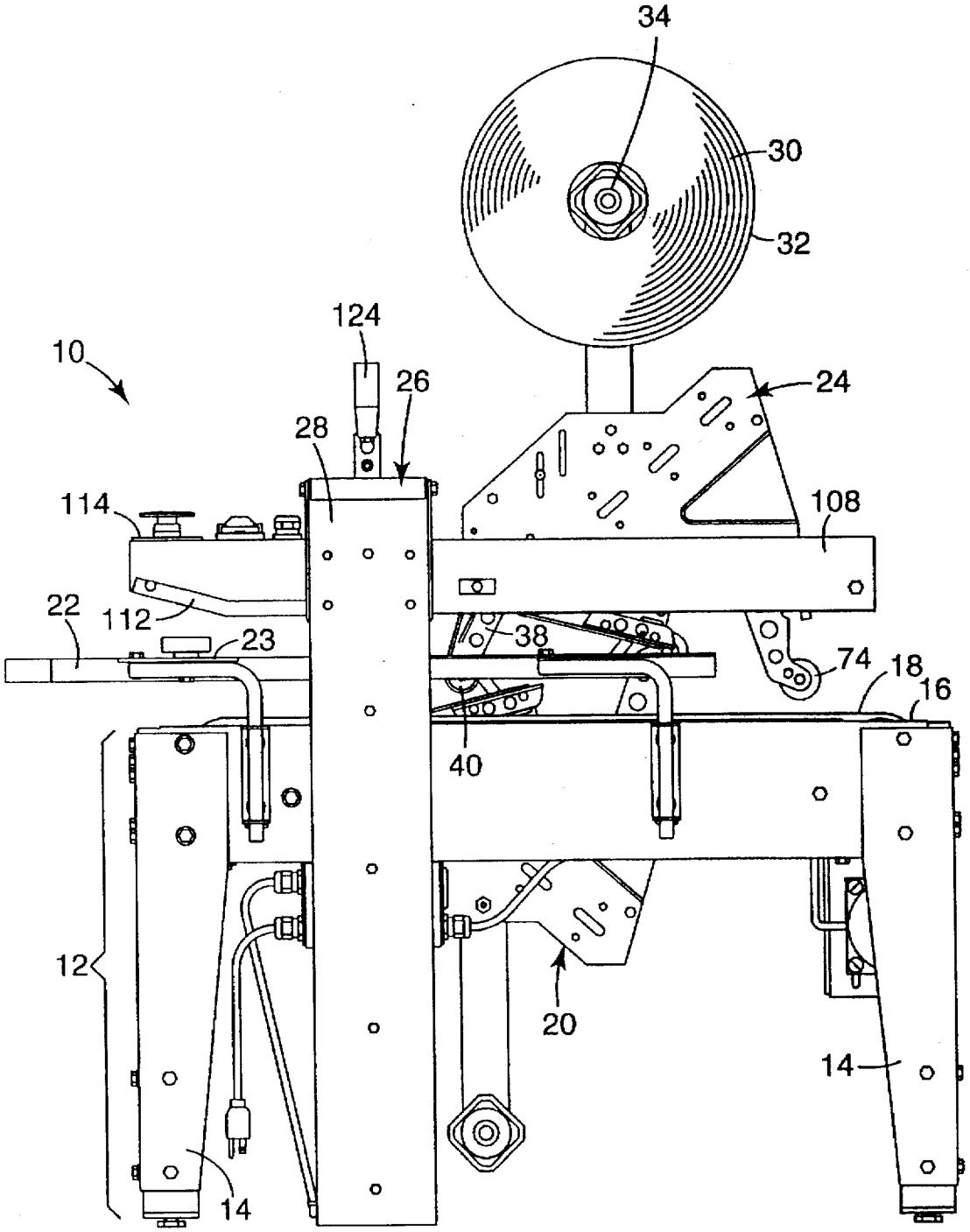
FIG. 1 is a side view of an apparatus for applying tapes to objects of the present invention.

The box sealing apparatus of this invention (also referred to as a case sealer) can incorporate two tape-applying devices disposed to apply lengths of pressure sensitive adhesive coated tape around the peripheries of spaced rectangular objects, such as boxes, cases, and cartons, driven along a predetermined path. Other objects having a leading surface and an adjacent longitudinal surface that join at a leading edge, such as stacks of sheet goods, or filled gusseted bags, can be used with this apparatus. The apparatus can apply various tapes to various objects, but has particularly utility in applying L-clips and C-clips of tape to seal boxes.

This case sealer is designed to be adjustable to accommodate taping heads of various widths. In one embodiment, the case sealer can be adjusted to accommodate three taping head widths: 2 inches (50.8 mm), 60 mm, and 3 inches (76.2 mm). Adjustment also works with any taping head width range, such as from 1 inch (25.4 mm) to 12 inches (304.8 mm). By adjusting the case sealer head width, the minimum width box can be run for the particular taping head width.

Figure 2:
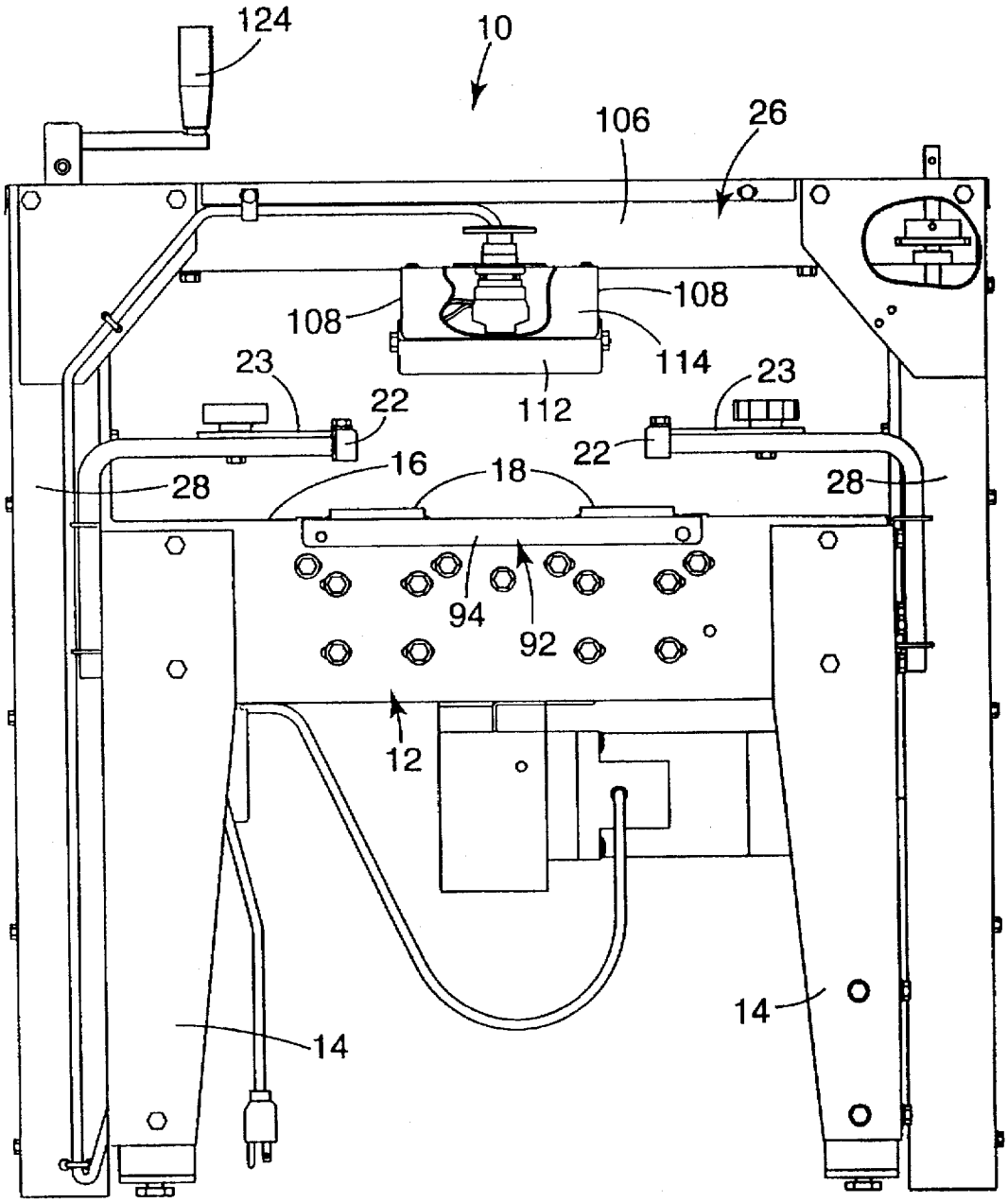
FIG. 2 is a front view of the apparatus of FIG. 1 with the taping heads removed.
Figure 3:
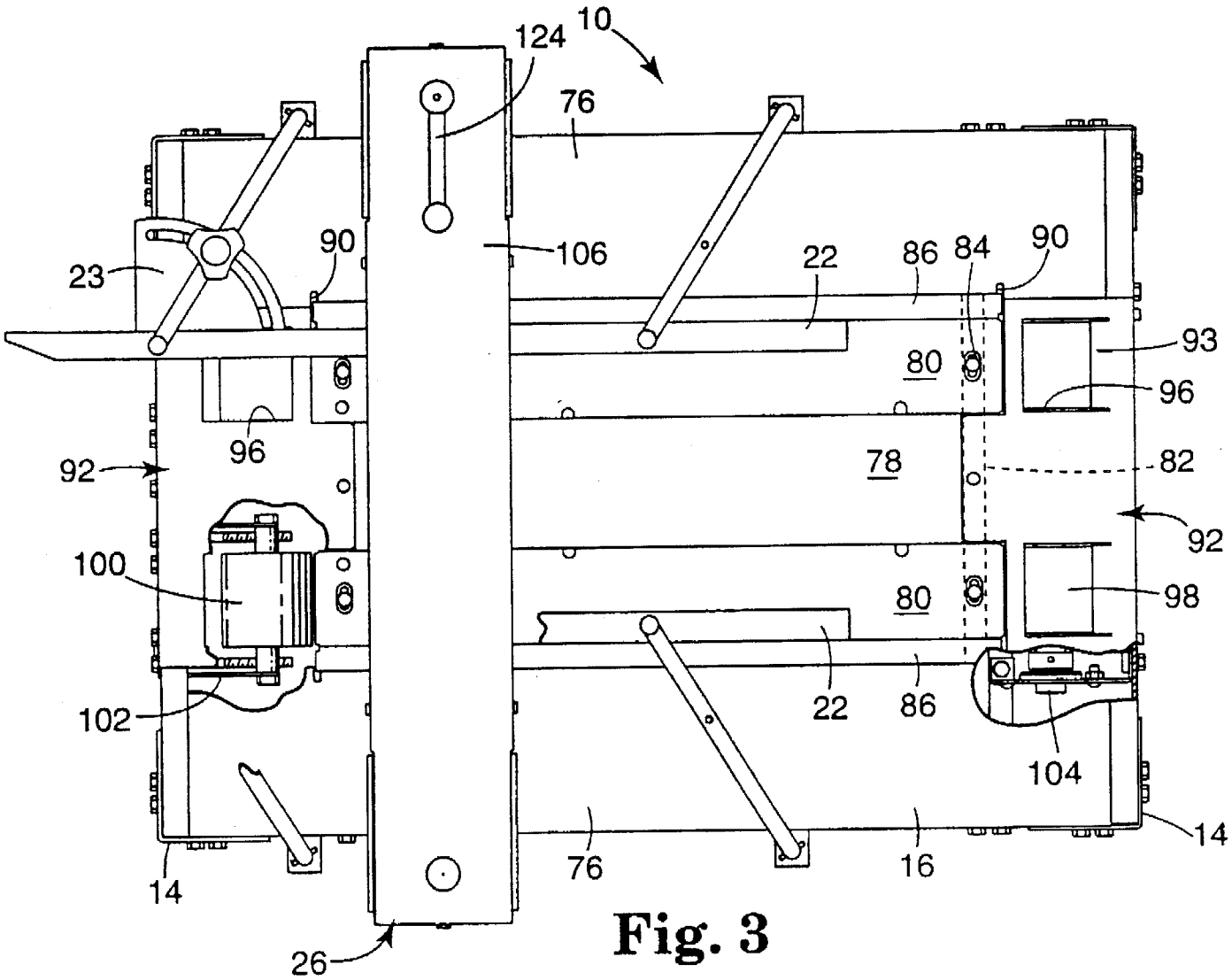
FIG. 3 is a top view, partially in section of the apparatus of FIG. 1 with the taping heads, belts, and other parts removed.

FIGS. 1–3 show a case sealer 10 including a base 12 mounted on legs 14. The base 12 includes a surface such as a bed 16 over which driven belts 18 move boxes. The base 12 supports a lower tape application member, such as a lower taping head 20. Adjustable guides 22 can engage the sides of a box. The case sealer 10 includes mechanisms 23 for adjusting the guides 22 relative to each other to positions at which they will engage the side surfaces of boxes with different widths to propel the boxes along their path.

The driven belts 18 drive boxes over the bed 16 and under an upper tape application member, such as an upper taping head 24. The belts 18 can be adjusted relative to each other, as described below, to positions at which they will engage boxes having different widths to propel the boxes along their path.

An upper frame 26, connected to the base 12 by supporting columns 28, supports the upper taping head 24, and can adjust vertically to bring the upper taping head 24 to a level for contact with the leading surface of a box propelled through the case sealer 10. The upper frame 26 can be manually positioned at a desired height for boxes, and it can also self-adjust to boxes that are slightly higher than the preset position. The taping heads 20, 24 are known, as illustrated in case sealer catalogs and sold by Minnesota Mining and Manufacturing Company of St. Paul, Minn., under the name 3M-Matic™.

The tape supply includes a roll 30 of tape 32, supported on a tape hub 34. The upper taping head 24 includes rollers (not shown) mounted on a support arm 38 and around which the tape passes between the roll 30 and an application roller 40 of the upper taping head 24. The lower taping head 20 includes a similar roller and tape path arrangement (not shown).

Figure 4:
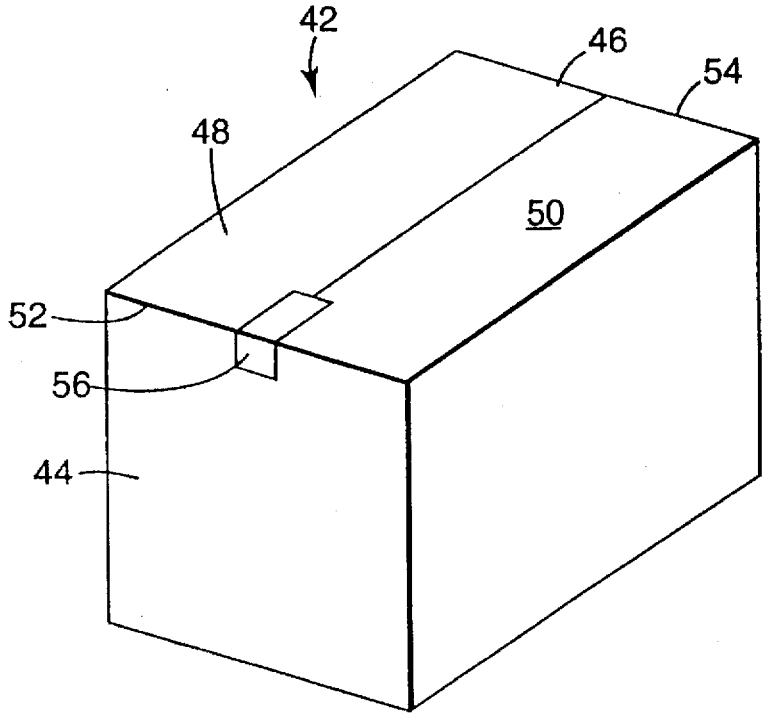
FIG. 4 is a perspective view of a box sealed with an L-clip of tape.

FIG. 4 shows a box 42 sealed using the case sealer 10. The box 42 includes a leading surface 44 and a longitudinal surface 46 formed of flaps 48, 50, which may be folded into abutting relationship to close the box. The leading and longitudinal surfaces 44, 46 join at a leading edge 52, and the longitudinal surface 46 and the trailing surface (not shown) join at a trailing edge 54. As shown, a tape section 56 is applied along a portion of the leading surface 44, across the leading edge 52, and along a portion of the interface between the flaps 48, 50 to form the L-clip of tape that seals the carton. C-clips of tape also can seal the carton.

The support arm 38, can move in a curvilinear manner. The application roller 40 need not be a roller; it could be fixed. The angle between the axis along which the support arm moves and the horizontal may be varied depending on the properties of the carton and the parameters of the sealing system. The angle can be between 35° and 55°.

A mechanism (not shown) for moving the support arm 38 from an extended position to a retracted position to apply the tape is used. When applying L-clips of tape, a pneumatic cylinder and piston is attached to the upper frame 26, and shifts the support arm 38 from an extended position to a retracted position responsive to a signal. When applying C-clips of tape, springs are used to bias the support arm 38 between the extended and retracted positions. One system is described in U.S. Pat. No. 5,228,943.

When the support arm 38 is extended, the application roller 40 is positioned for contact with the leading surface 44 of the box 42. When the support arm 38 is retracted, the application roller 40 is located above the longitudinal surface 46 of the box 42. The retracted position allows the box 42 to pass beneath the application roller 40 to withdraw tape from the tape source 30.

Because the objects to which an L-clip of tape 32 is applied may be susceptible to puncture or damage (e.g., corrugated cardboard cartons and gusseted paper bags), the tape applying device applies a minimal level of impact force when it contacts the leading surface of the object, and can be adapted so that the application roller 40 does not contact the leading surface of the object after the initial impact. This is accomplished by retracting the support arm 38 immediately after the object contacts the tape 32 and application roller 40. This can lower the impact force and eliminate application forces applied by the application roller 40 to the object. The support arm 38 can be moved into the retracted position responsive to a signal transmitted by a sensor which perceives the position of either the box 42 or of a component of the case sealer 10.

A cutting member such as a knife (not shown), severs a length of pressure sensitive adhesive tape from the tape roll 30. A mechanism (not shown) for moving the knife to cut the tape is used. The knife can be connected to a pneumatic cylinder and piston when L-clips of tape are applied. When C-clips of tape are applied, other mechanisms for moving the knife can be used, such as those described in U.S. Pat. No. 5,228,943.

When the knife extends through the tape path, it cuts a section of the tape 32 from the tape roll 30. In one embodiment, the knife returns to the retracted position after it has reached the extended position. Retracted, the knife is prepared for activation during subsequent cycles. The knife moves, responsive to a signal from a sensor triggered by the retracted position of the support arm 38, to cut the tape 32.

Many types of tape are suitable for use with the case sealer ! 0, but film tape is preferred over filament tape because film tape is easier to cut. Film box sealing tape, identified by numbers 355, 369, 371, 372, 373, 375, and 600, available from Minnesota Mining and Manufacturing Company of St. Paul, Minn., can be used with the case sealer 10. Tapes of different widths may also be used, including tapes measuring from 1–3 inches (25.4–76.2 mm) wide.

A buffing roller 74, supported by the upper taping head 24, could be used to press the portion of the tape applied to the box. The buffing roller could alternatively be fixed to the upper taping head 24.

Figure 5:
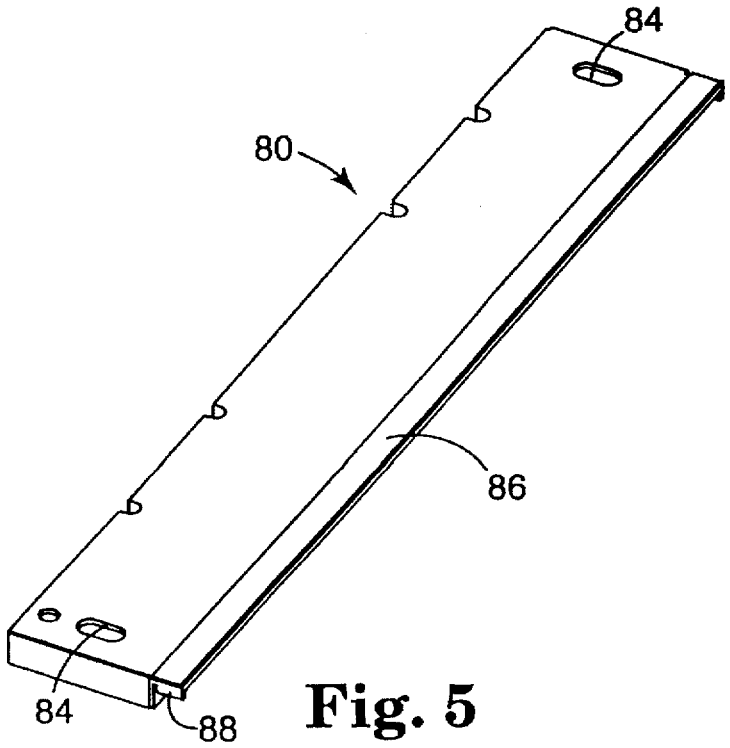
FIG. 5 is a perspective view of a filler plate of the apparatus of FIG. 1.

The case sealer 10 can be adjusted to accommodate different tape widths from the lower and upper taping heads 20, 24 and smaller minimum width boxes by moving or replacing several components. Referring to FIG. 3, the bed 16 of the base 12 is formed of left and right bed portions 76 and a wide central cavity or open portion 78. Left and right filler plates 80 (FIG. 5), which can be identical, are mounted in the central open portion 78 adjacent the respective left and right bed portions 76. The filler plates 80 extend longitudinally and, in the illustrated embodiments, are formed as rectangular channels, although other shapes could be used. The filler plates 80 rest on cross bars 82 of the base 12, although other support systems can be used. The lower taping head 20 rests in slots formed in the filler plates 80.

The filler plates 80 are secured to the cross bars 82 using any adjustable fastening method. A single hole can be formed at each end of each filler plate 80 and a bolt or screw (not shown) secures the filler plate 80 to the cross bar 82. The cross bar 82 can have a plurality of holes at desired locations, or simply a single slot to receive the bolt or screw. Alternatively, as shown, a slot 84 can be formed on the filler plate 80. A drive belt 18 passes around and over the filler plates 80 to transport boxes 42 through the case sealer 10.

An arm portion 86 extends from the main portion of the filler plate. The arm portion 86 could be formed as part of an L-shaped member connected to the main portion. The arm portion 86 overlaps the edge of the adjacent bed portion 76 of the base 12 regardless of the position of the filler plate 80. A lip 88 can be formed on each end of the arm portion 86 of the filler plate 80. The lip 88 is received in a slot 90 formed in the bed portion 76 to secure the filler plates 80 in place longitudinally. The lip 88 also prevents lower flaps of a box 42 from hooking on the filler plates 80 and damaging the box.

Figure 6:
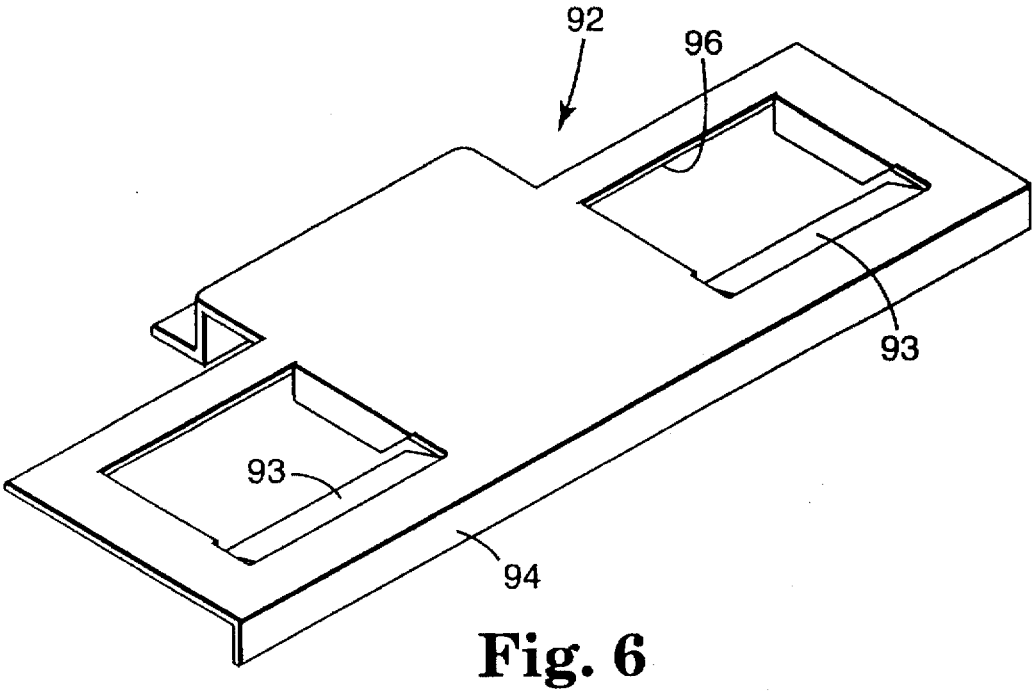
FIG. 6 is a perspective view of a guard plate of the apparatus of FIG. 1.

A front guard 92 is placed on the front of the bed 16 across the front ends of both filler plates 80, and a rear guard 92 is placed on the rear of the bed across 16 the rear ends of both filler plates 80. The guards 92 (FIG. 6) each have a lip 94 which fits over the end of the bed 16 of the base 12, and two openings 96 through which the drive belts 18 pass. In the illustrated embodiments. Three sets of guards 92 are intended to be used, one for each tape head width.

The width of the openings 96 remains the same in each guard 92, but it is transversely located to correspond to the belt location. A single guard set with wide drive belt openings which correspond to all drive belt locations could be used. However, it is desirable to use multiple guards 92 to minimize the opening 96 width and reduce the chances of damage or injury due to, for example, operators inserting tools or hands through the openings. The rear surface 93 of the rear guard 92 can be angled downwardly to prevent items from being pulled into it by the belts 18. The front guard 92 can be longer than the rear guard to accommodate longer openings 96 to enable tightening the belts 18 by moving the idler roller 100 and lengthening the distance between the drive and idler rollers as the belts stretch with use.

The drive belts 18 (not shown in FIG. 3) each pass around a crowned drive roller 98 and a crowned idler roller 100. The rollers 98, 100 can move and adjust in the transverse direction to the drive belt 18 location to accommodate adjusting the minimum box width that can be taped. This permits increasing the amount of belt contact with the boxes. (Generally, at least 0.5 inch (12.7 mm) of contact is necessary on each edge of the box.) The idler rollers 100 can be slid to various locations on a fixed bracket. Alternatively, as shown, the idler rollers 100 can be fixed in a bracket 102 that is mountable in different locations on the base 12. The drive rollers 98 are selectively mounted and keyed at different locations on the drive shaft 104 which is fixed in its longitudinal direction. This obviates moving the motor and sprocket of the drive assembly. The drive roller 98 locations can be infinitely variable within a range on the drive shaft 104.

The lower taping head 20 cavity is adjusted by sliding the filler plates 80 into the proper position, sliding the idler roller brackets 102 into the proper position, relocating the drive rollers 98 to the proper position, and inserting the appropriate front and rear guards 92.

The case sealer 10 also can be adjusted to accommodate different upper taping head 24 tape widths by moving or replacing several components. In the illustrated embodiment, three components of the upper frame 26 are replaced to accommodate different width upper taping heads. The cross brace 106 of the upper frame 26 can accommodate different widths without needing modification or replacement. Various slots on the cross brace can receive components having different widths.

Figure 7:
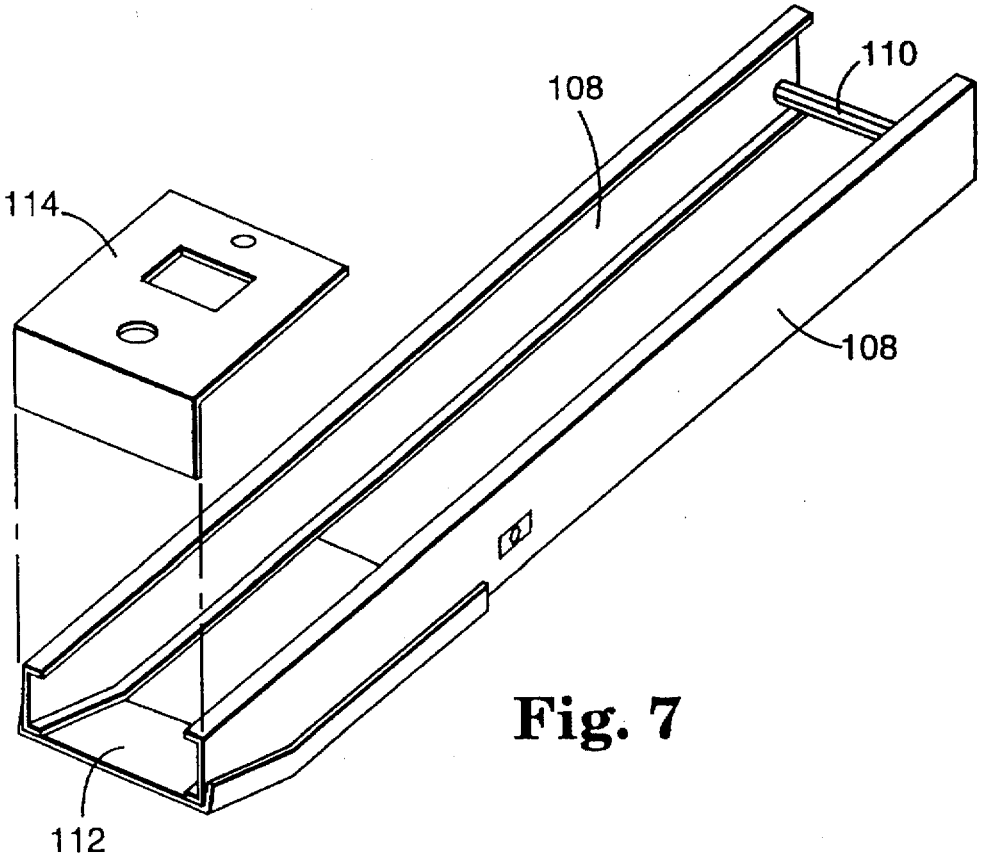
FIG. 7 is an exploded perspective view of the upper frame of the apparatus of FIG. 1.

Referring to FIG. 7, the upper frame 26 also includes two support members, such as skis 108, which are disposed longitudinally along the box transport direction and between which the upper taping head 24 is disposed. These skis 108 need not be replaced. The upper taping head 24 rests in slots (not shown) formed in the skis 108.

Figure 9:
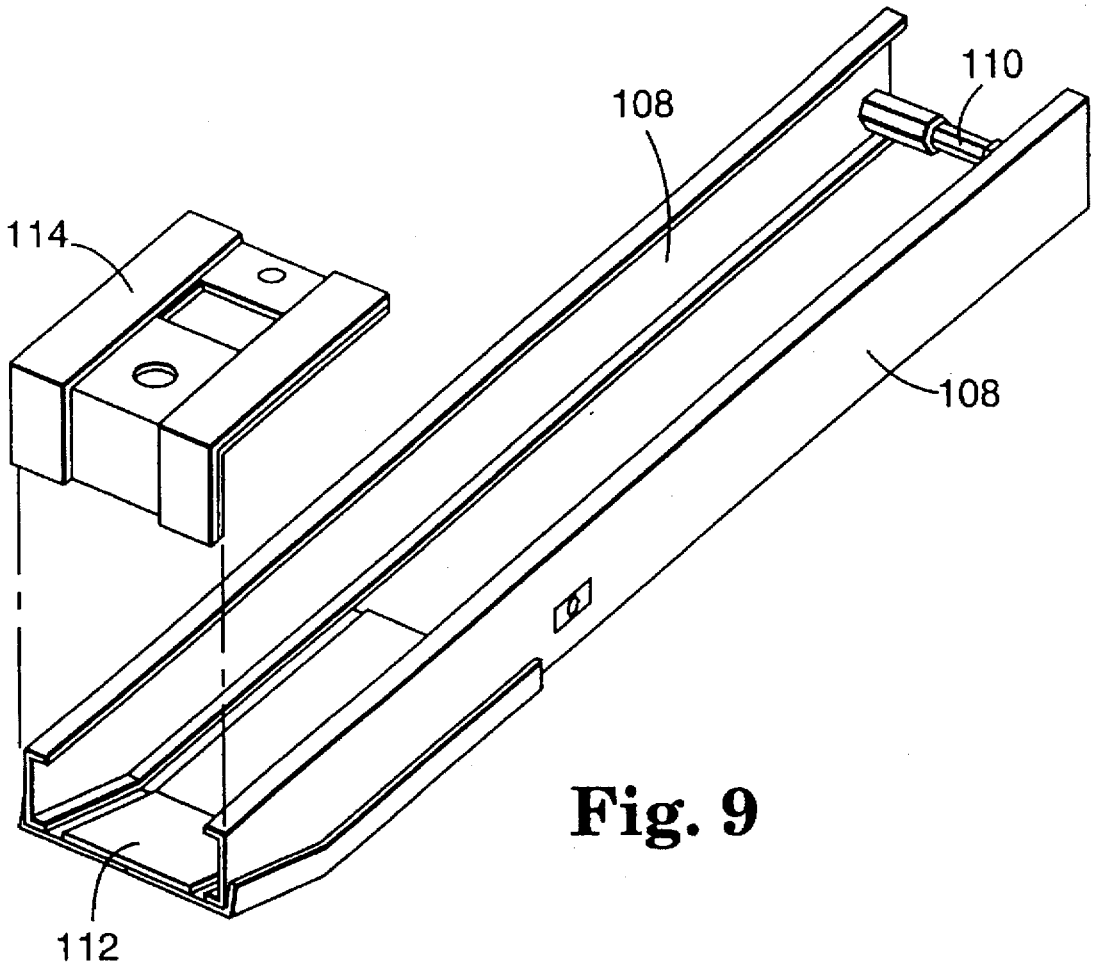
FIG. 9 is a perspective view of a nestable rear spacer, front support plate, and top cover according to another embodiment of the invention.

The two skis 108 are connected by a rear spacer 110, a front support plate 112 mounted below the skis 108 and which guides the tops of boxes 42, and a top cover 114 which is located on top of the skis 108 above the front support plate 112. These three components are replaced with similar components of different widths to accommodate width changes. These components can alternatively be formed of overlapping, nesting portions to adjust the width, as shown in FIG. 9. The upper frame 26 is adjusted by replacing the front support plate 112, the top cover 114, and the rear spacer 110 with new parts, and sliding the upper frame 26 into position.

The case sealer can be designed with a nylon column guide system. Two strips of nylon for each supporting column 28 are located in U channels to provide transverse stability. One strip of nylon for each support column has a precision groove machined into it. This nylon strip runs on a steel rail 115 and provides machine-direction stability. The nylon strips provide a large surface contact area and have low wear and friction properties ideal for this type application. These columns replace bearings or rollers for support which require fragile parts and complicated alignment systems.

In another aspect of the case sealer 10, a compression spring is used for each support column to support the upper frame 26. This allows the upper taping head 24 to float to accommodate boxes 42 of slightly different heights. Enough upper frame and taping head weight is retained to force the box 42 down and ensure sufficient traction on the drive belts 18. Some of the weight is supported by the springs to prevent crushing light-weight boxes.

Figure 8:
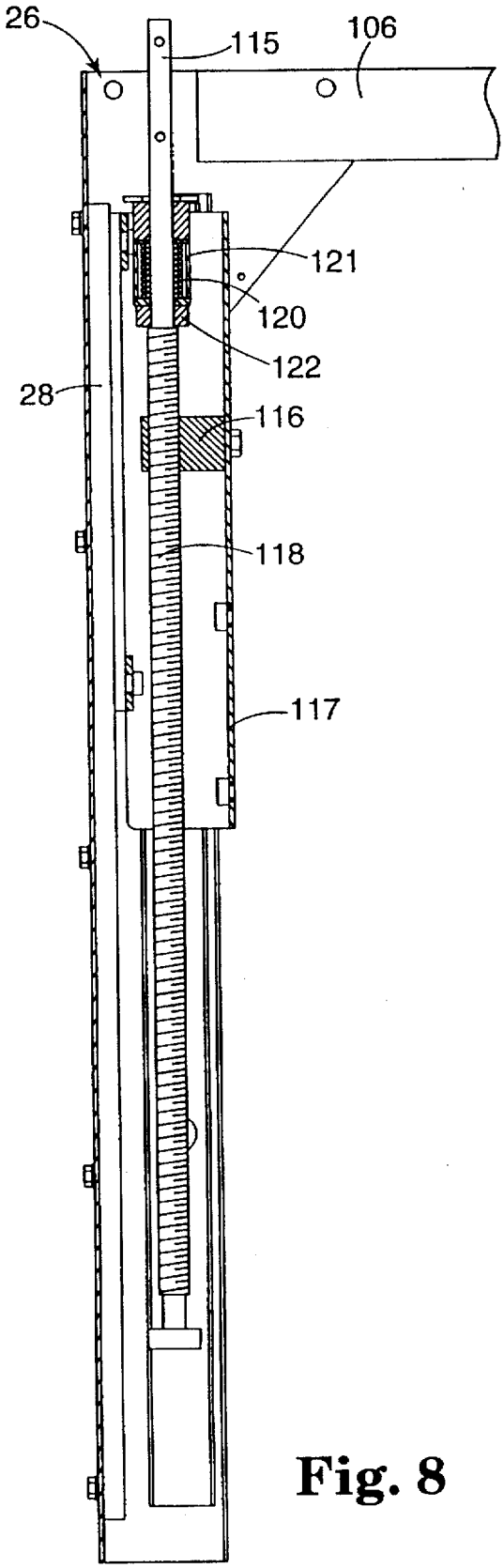
FIG. 8 is a cross-sectional view of the upper frame support system.

In this design, as shown in FIG. 8 a nut 116 is attached to a bracket 117 which is fixed to the base 12. The supporting columns 28 hang down from the upper frame 26 and slidably engage this bracket 117. A lead screw 118 is threaded through and supported by the nut 116. The lead screw 118 and nut 116 remain stationary during sealing. The height of the upper frame 26 can be adjusted to a specific height of box by turning the lead screw 118 within the nut, either manually using a crank 124 or with a motor. A spring 120 is supported in a housing 121 by an upper surface of a bearing 122 residing on top of the screw 118, and the upper frame 26 rests on the housing 121 and compresses the spring 120. If the upper head 26 is lifted by a box 42, the upper frame 26 lifts and the spring 120 extends.

This differs from known designs in which the lead screw is supported by a nut which is supported by a stop attached to the sealer frame. The nut is partially supported by a compression spring residing on a stop attached to the frame. If the upper head is lifted by a box, the upper head frame, lead screw, and nut are also lifted. In the present invention, because the fixed nut supports the screw, which supports the upper frame assembly, it is more reliable than floating nut configurations.

We claim:

1. A tape applying apparatus adaptable for receiving at least one taping head for applying a section of tape to an object, wherein the apparatus is adjustable to accommodate various width taping heads and various width objects, wherein the apparatus comprises a base having a surface on which the object travels, wherein the base comprises:

left and right bed portions separated by a central open portion which receives the taping head;

left and right filler plates mounted longitudinally adjacent the respective left and right bed portions, and over each of which a drive belt passes to transport the object through the apparatus; and means for adjusting a distance between the left and right filler plates to define the central open portion to accommodate taping heads having different widths.

2. A tape applying apparatus adaptable for receiving at least one taping head for applying a section of tape to an object, wherein the apparatus is adjustable to accommodate various width taping heads and various width objects, wherein the apparatus comprises a base having a surface on which the object travels, wherein the base comprises:

left and right bed portions separated by a central open portion;

left and right filler plates mounted longitudinally in the central open portion adjacent the respective left and right bed portions, and over each of which a drive belt passes to transport the object through the apparatus, wherein each filler plate comprises an arm portion having ends which rests over the adjacent bed portion with sufficient overlap to prevent any gaps between the filler plate and the adjacent bed portion regardless of whether the filler plates are arranged to create a minimum width central open portion or a maximum width central open portion; and means for adjusting a distance between the left and right filler plates.

3. The apparatus of claim 2 wherein each filler plate further comprises a lip formed on each end of the arm portion, wherein each lip is receivable in a slot formed in the adjacent bed portion.

4. The apparatus of claim 1 further comprising means for mounting the filler plates on the base comprising cross bars on which the filler plates rest wherein the means for adjusting is selected from the groups consisting of (a) at least one slot formed on at least one of the filler plates for receiving one of the cross bars, (b) at least one slot formed in at least one of the cross bars for receiving one of the filler plates, and (c) both (a) and (b); and wherein the location of the cross bar of (a), the filler plate of (b), or both the cross bar and the filler plate of (c) within the respective slot determines the width of the central open portion.

5. A tape applying apparatus adaptable for receiving at least one taping head for applying a section of tape to an object, wherein the apparatus is adjustable to accommodate various width taping heads and various width objects, wherein the apparatus comprises a base having a surface on which the object travels, wherein the base comprises:

left and right bed portions separated by a central open portion;

left and right filler plates mounted longitudinally in the central open portion adjacent the respective left and right bed portions, and over each of which a drive belt passes to transport the object through the apparatus wherein both filler plates each have a front end and a rear end;

means for adjusting a distance between the left and right filler plates; and a replaceable front guard placed across the front ends of both filler plates, and a replaceable rear guard placed across the rear ends of both filler plates, wherein each guard comprises: a lip which fits over the end of the base; and two openings through which the drive belt passes.

6. The apparatus of claim 5 further comprising a drive roller located within a respective opening in one guard plate for each said belt and an idler roller located within a respective opening in the other guard plate for each said belt, wherein each of the belts pass around the respective drive roller and the respective idler roller, and wherein the rollers are adjustable in a transverse direction to accommodate adjustment of the filler plates.

7. The apparatus of claim 1 further comprising a lower taping head for applying the tape to at least one of(a) a lower longitudinal surface, (b) a portion of a leading surface adjacent the lower longitudinal surface, and (c) a portion of a trailing surface adjacent the lower longitudinal surface of the object.

8. The apparatus of claim 1 further comprising an upper frame adaptable for supporting an upper taping head above the base portion, wherein the upper frame comprises:

a cross brace;

two support members which are mounted longitudinally on the cross brace and which can receive between them an upper taping head;

a rear spacer which connects the two support members;

a front support plate mounted below the support members and which guides the top of the object; and a top cover which is located on top of the support members above the front support plate, wherein the rear spacer, front support plate, and top cover are at least one of (a) replaceable with respective rear spacers, front support plates, and top covers that have different widths and (b) formed of overlapping, nesting portions to adjust the width.

9. The apparatus of claim 8 further comprising an upper taping head for applying the tape to at least one of (a) an upper longitudinal surface, (b) a portion of a leading surface adjacent the upper longitudinal surface, and (c) a portion of a trailing surface adjacent the upper longitudinal surface of the object.

10. A tape applying apparatus adaptable for receiving at least one taping head for applying a section of tape to an object, wherein the apparatus is adjustable to accommodate various width taping heads and various width objects, wherein the apparatus comprises a base having a surface on which the object travels, wherein the base comprises:

left and right bed portions separated by a central open portion;

left and right filler plates mounted longitudinally in the central open portion adjacent the respective left and right bed portions, and over each of which a drive belt passes to transport the object through the apparatus;

means for adjusting a distance between the left and right filler plates;

supporting columns translatable with respect to the base;

an upper frame mounted on the supporting columns; and means for adjusting and allowing the upper frame to float to accommodate different objects of different heights, wherein the adjusting and allowing to float means comprises:

a nut fixed to the base at a location corresponding to each supporting column;

a lead screw supported by each nut, wherein the lead screw can be threaded through the nut to raise and lower the upper frame; and a spring supported at an upper surface of each lead screw, wherein the upper frame rests on and compresses the spring and the upper frame can be raised to relax compression of the spring.

11. An upper frame adaptable for supporting an upper taping head above a base portion of a tape applying apparatus, wherein the upper frame comprises:

a cross brace;

two support members which are mounted longitudinally on the cross brace and which can receive between them an upper taping head;

a rear spacer which connects the two support members;

a front support plate mounted below the support members and which guides tops of objects; and a top cover which is located on top of the support members above the front support plate, wherein the rear spacer, front support plate and top cover are at least one of(a) replaceable with respective rear spacers, front support plates, and top covers that have different widths and that accommodate taping heads having different widths and (b) formed of overlapping, nesting portions to adjust the width.

12. A tape applying apparatus having at least one taping head for applying a section of tape to an object, wherein the apparatus is adjustable to accommodate various width taping heads comprising:

a lower taping head for applying the tape to at least one of(a) a lower longitudinal surface, (b) a portion of a leading surface adjacent the lower longitudinal surface, and (c) a portion of a trailing surface adjacent the lower longitudinal surface of the object;

a base having a surface on which the object travels and an opening for receiving the lower taping head, wherein the base comprises:

left and right bed portions separated by a central open portion;

left and right filler plates mounted longitudinally in the central open portion adjacent the respective left and right bed portions, and over which drive belts pass to transport the object through the apparatus, wherein each filler plate comprises an arm portion having ends which rest over the adjacent bed portion with sufficient overlap to prevent any gaps between the filler plate and the adjacent bed portion regardless of whether the filler plates are arranged to create a minimum width lower taping head or a maximum width lower taping head;

means for adjusting the distance between the left and right filler plates to adjust a width of the central open portion from the minimum width to the maximum width; and a replaceable front guard placed across front ends of both filler plates, and a replaceable rear guard placed across rear ends of both filler plates, wherein each guard comprises: a lip which fits over the end of the base; and two openings through which the drive belts pass.

13. The apparatus of claim 12 wherein each filler plate further comprises a lip formed on each end of the arm portion, wherein each lip is receivable in a slot formed in the adjacent bed portion to secure the filler plates in place longitudinally.

14. The apparatus of claim 12 further comprising means for mounting the filler plates on the base comprising cross bars on which the filler plates rest wherein the means for adjusting is selected from the groups consisting of (a) at least one slot formed on at least one of the filler plates for receiving one of the cross bars, (b) at least one slot formed in at least one of the cross bars for receiving one of the filler plates, and (c) both (a) and (b); and wherein the location of the cross bar of (a), the filler plate of (b), or both the cross bar and the filler plate of (c) within the respective slot determines the width of the central open portion.

15. The apparatus of claim 12 further comprising two drive rollers located in respective openings in one guard plate for each said belt and two idler rollers located in respective openings in the other guard plate for each said belt where each of the drive belts passes around the respective drive roller and the respective idler roller adjacent to the respective filler plate, and wherein the rollers are adjustable in a transverse direction to accommodate adjustment of the filler plates.

16. The apparatus of claim 12 further comprising:

an upper taping head for applying the tape to at least one of (a) an upper longitudinal surface, (b) a portion of a leading surface adjacent the upper longitudinal surface, and (c) a portion of a trailing surface adjacent the upper longitudinal surface of the object;

an upper frame for supporting an upper taping head above the base portion, wherein the upper frame comprises:

a cross brace;

two support members which are mounted longitudinally on the cross brace and which can receive between them an upper taping head;

a rear spacer which connects the two support members;

a front support plate mounted below the support members and which guides the top of the object; and a top cover which is located on top of the support members above the front support plate, wherein the rear spacer, front support plate, and top cover are at least one of (a) replaceable with respective rear spacers, front support plates, and top covers that have different widths and that accommodate taping heads having different widths and (b) formed of overlapping, nesting portions to adjust the width.

* * * * *